US005805707A

United States Patent [19]

Nakano

[11] Patent Number: 5,805,707

[45] Date of Patent: Sep. 8, 1998

[54] RADIO PAGER WITH A DISPLAY CONTROL CAPABILITY

[75] Inventor: Yasushi Nakano, Shizuoka, Japan

[73] Assignee: NEC Corporation, Tokyo, Japan

[21] Appl. No.: 685,825

[22] Filed: Jul. 25, 1996

[30] Foreign Application Priority Data

Jul. 27, 1995 [JP] Japan ..... 7-191332
Aug. 24, 1995 [JP] Japan ..... 7-215550

[51] Int. Cl.[6] ..... H04K 1/00
[52] U.S. Cl. ..... 380/49; 380/43; 380/46
[58] Field of Search ..... 380/49, 43, 46, 380/44, 31

[56] References Cited

U.S. PATENT DOCUMENTS 5,146,217 9/1992 Holmes et al. ..... 340/825.44
5,283,832 2/1994 Lockhart et al. ..... 380/49

FOREIGN PATENT DOCUMENTS 0520514 12/1992 European Pat. Off. .
0597449 5/1994 European Pat. Off. .
2252692 8/1992 United Kingdom .
WO9217006 10/1992 WIPO .

OTHER PUBLICATIONS

Motorola Technical Developments, vol. 11, Oct. 1990, pp. 100–103.
Patent Abstracts of Japan, vol. 13, No. 232, May 29, 1989.
Patent Abstracts of Japan, vol. 16, No. 364, Aug. 6, 1992.

*Primary Examiner*—David C. Cain
*Attorney, Agent, or Firm*—Sughrue, Mion, Zinn, Macpeak & Seas, PLLC

[57] ABSTRACT

In a radio pager, when encrypting information is attached to a received message, the message is written to an encrypted message memory in distinction from an ordinary message. The message stored in the encrypted message memory is read out and displayed only when decrypting information matching the encrypting information is entered by the user of the pager. The encrypting information may be added to the received message by the user before the message is written to the encrypted message memory. With this configuration, the pager allows only the user or an authorized person to see private messages stored in the encrypted message memory.

11 Claims, 7 Drawing Sheets

START
S201
SWITCH OPERATED ?
NO
YES
S202
TIME t ELAPSED ?
YES
NO
NO
DECRYPTING INFORMATION INPUT ?
S203
S206
READ MESSAGE OUT OF RAM 6
YES
NO
COINCIDENT ?
S204
YES
READ ENCRYPTED MESSAGE DESIGNATED BY DECRYPTING INFORMATION OUT OF MEMORY 7
S205
DISPLAY
S207
END

START
S401
READING OPERATION PERFORMED ?
S402
TIME t ELAPSED ?
ENCRYPTING INFORMATION INPUT ?
S403
S406
READ MESSAGE OUT OF RAM 6
COINCIDENT ?
S404
READ MESSAGE OUT OF ENCRYPTED MESSAGE MEMORY 7
S405
DISPLAY
S407
END

RADIO PAGER WITH A DISPLAY CONTROL CAPABILITY

BACKGROUND OF THE INVENTION

The present invention relates to a radio pager and, more particularly, to a radio pager capable of controlling the display of received messages.

A radio pager extensively used today includes a memory for storing received messages. The messages can each be easily read out of the memory if the user of the pager performs a particular reading operation. The message read out is displayed on a display mounted on the pager. This, however, brings about a problem that even persons other than the user or authorized person can easily see the messages including private messages.

SUMMARY OF THE INVENTION

It is therefore an object of the present invention to provide a radio pager capable of storing received messages in such a manner that only the user of the pager or an authorized person can see private received messages.

In accordance with the present invention, a radio pager has a receiving section for receiving a paging signal sent from a caller, a storage for storing a message included in the paging signal, a first decision unit for determining whether or not encrypting information for inhibiting the message from being displayed is attached to the paging signal, a display for displaying the message, and a second decision unit for determining whether or not the message with the encrypting information should be displayed.

Further, in accordance with the present invention, a radio pager has a receiving section for receiving a paging signal sent from a caller, a decision unit for determining whether or not encrypting information is attached to a message included in the paging signal, a first storage for storing the message to which the encrypting information is not attached, a second storage for storing the message to which the encrypting information is attached, a first reading section for reading the message out of the first storage, and a second reading section for reading the message out of the second storage.

Moreover, in accordance with the present invention, a radio pager has a receiving section for receiving a paging signal from a caller, a storage for storing a message included in the paging signal, a display for displaying the message, an adding section for allowing encrypting information to be added to the message for inhibiting the message from being displayed, and a decision unit for determining whether or not the message to which the encrypting information is added should be displayed.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
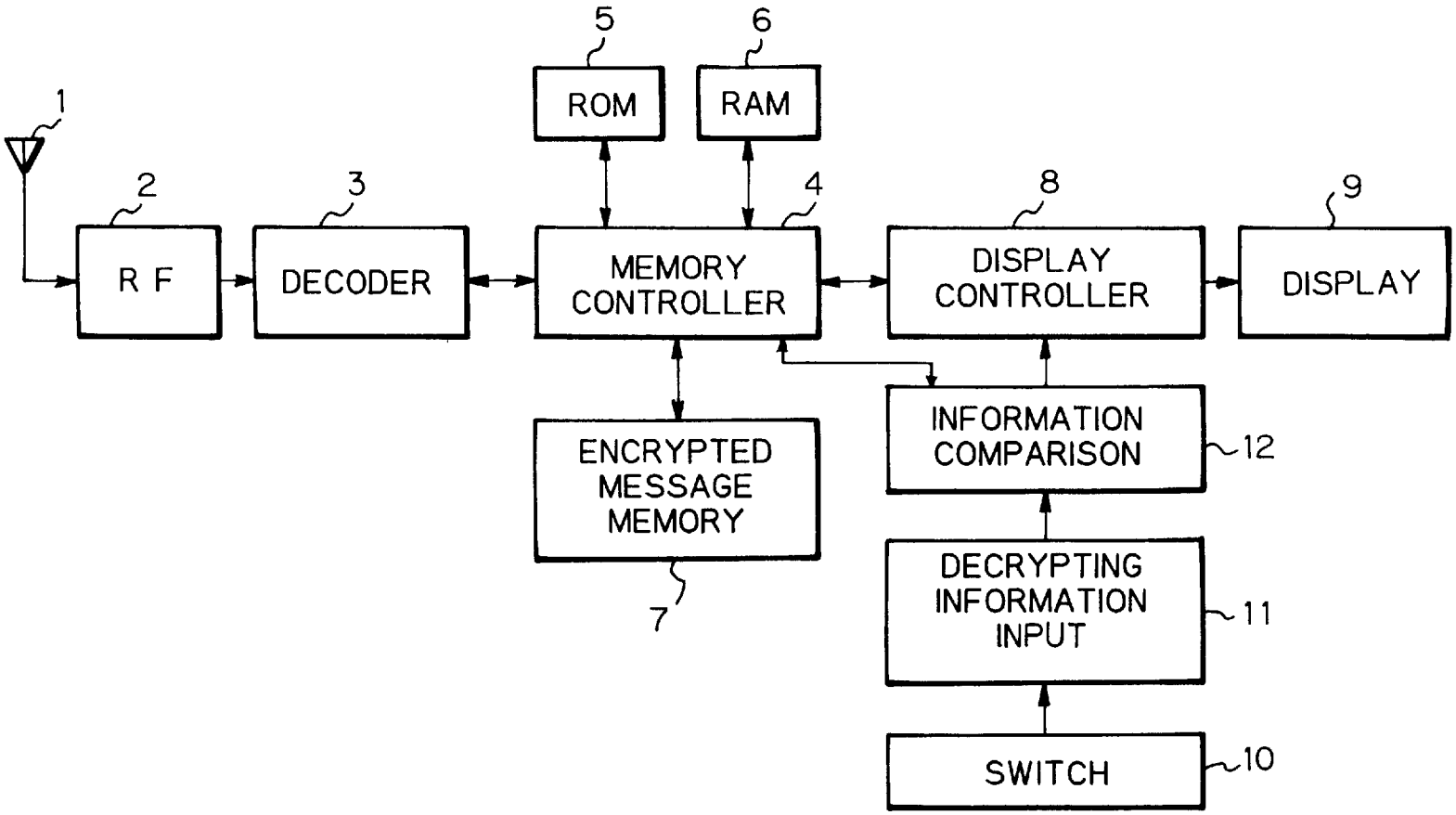
FIG. 1 is a block diagram schematically showing a radio pager embodying the present invention.

Referring to FIG. 1 of the drawings, a radio pager embodying the present invention is shown. As shown, the pager has an antenna 1, a radio section or RF (Radio Frequency) section 2, a decoder 3, a memory controller 4, a ROM (Read Only Memory) 5, a RAM (Random Access memory) 6, an encrypted message memory 7, a display controller 8, a display 9, a switch 10, decrypting information input 11, and an information comparison 12.

Message receipt and storage to be executed by the illustrative embodiment will be outlined first A paging signal coming in through the antenna 1 is demodulated by the RF section 2 and then input to the decoder 3. The decoder 3 compares an address number or identification (ID) number included in the demodulated signal with an address assigned to the pager and read out of the ROM 5 via the memory controller 4. If the two address signals compare equal, the decoder 3 delivers a message signal following the address number to the memory controller 4. If otherwise, the decoder 3 does not accept signals which may follow the ID. If encrypting information is attached to the message signal, the memory controller 4 writes the message signal in the encrypted message memory 7. The memory controller 4 writes a message signal without encrypting information in the RAM 6.

A procedure for displaying the stored message is as follows. When the user of the pager operates a message call switch 10, the display controller 8 sequentially displays messages stored in the RAM 6 via the memory controller 4. The messages stored in the RAM 6 are not of private nature, and are therefore simply displayed in response to the operation of the switch 10. On the other hand, assume that the user inputs decrypting information after the operation of the switch 10. Only if the decrypting information coincides with encrypting information, the message stored in the encrypted message memory 7 appears on the display 9.

As to the decrypting information, alphabets, numerals or similar symbols may be displayed on the display 9 and selectively entered on keys including scroll keys. The information comparison 12 compares the decrypting information entered via the decrypting information input 11 with the encrypting information. The decrypting information may be identical with the encrypted information or may be related to the latter in any suitable way. If the decrypting information coincides with the encrypting information, the display controller 8 reads a message signal designated by the decrypting information out of the encrypted message memory 7 via the memory controller 4. The message signal is displayed on the display 9.

Figures 2A, 2B, 2C, 2D:
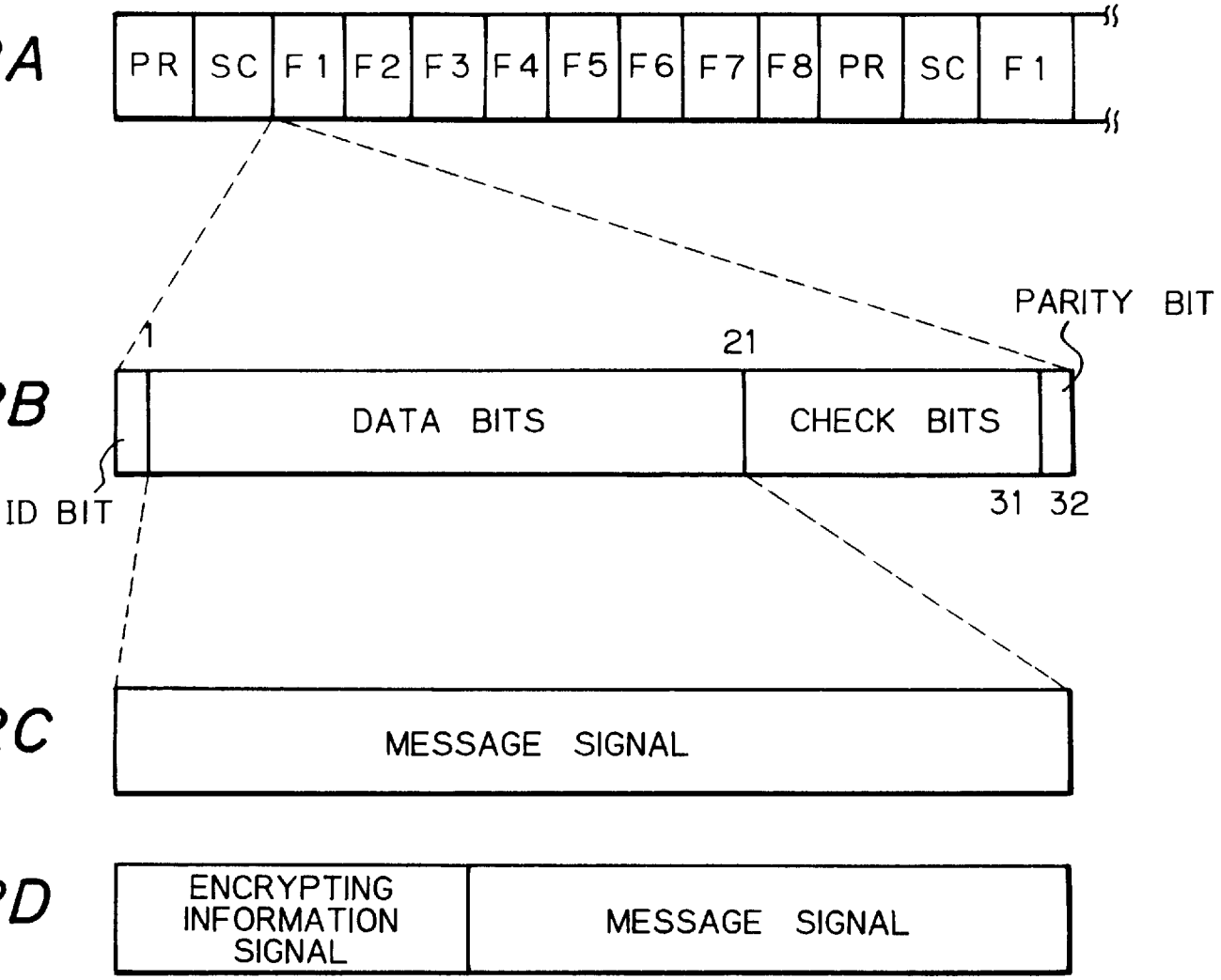
FIGS. 2A–2D show a specific signal format of a paging signal applicable to the embodiment.

FIG. 2A shows a POCSAG signal format belonging to a family of conventional signal formats applicable to a paging signal. As shown, the paging signal with the POCSAG format is made up of a preamble signal PR, a synchronizing code SC, and a plurality of consecutive frames F1–F8 each consisting of two codewords. As shown in FIG. 2B, each codeword has thirty-two bits in total, i.e., a single ID bit, twenty data bits, ten check bits, and a single parity bit. The ID bit shows whether data to follow is an address number or a message signal. For example, the ID bit shows that a data signal will follow if the ID bit is (logical) ZERO or that a message signal will follow if the ID bit is (logical) ONE.

The data bits shown in FIG. 2B are implemented only as a message signal as shown in FIG. 2C, or as a message signal including encrypting information as shown in FIG. 2D. The message signal shown in. FIG. 2C is simply written to the RAM 6 and can be displayed only if the message call switch 10 is operated. On the other hand, the message signal with the encrypting information shown in FIG. 2D is written to the encrypted message memory 7 by the memory controller 4. Once the message signal with the encrypting information is written to the memory 7, it will not appear on the display 9 unless decrypting information matching the encrypting information is input via the input 11. The encrypting information is selected beforehand by agreement between callers and the user of the pager.

Figure 3:
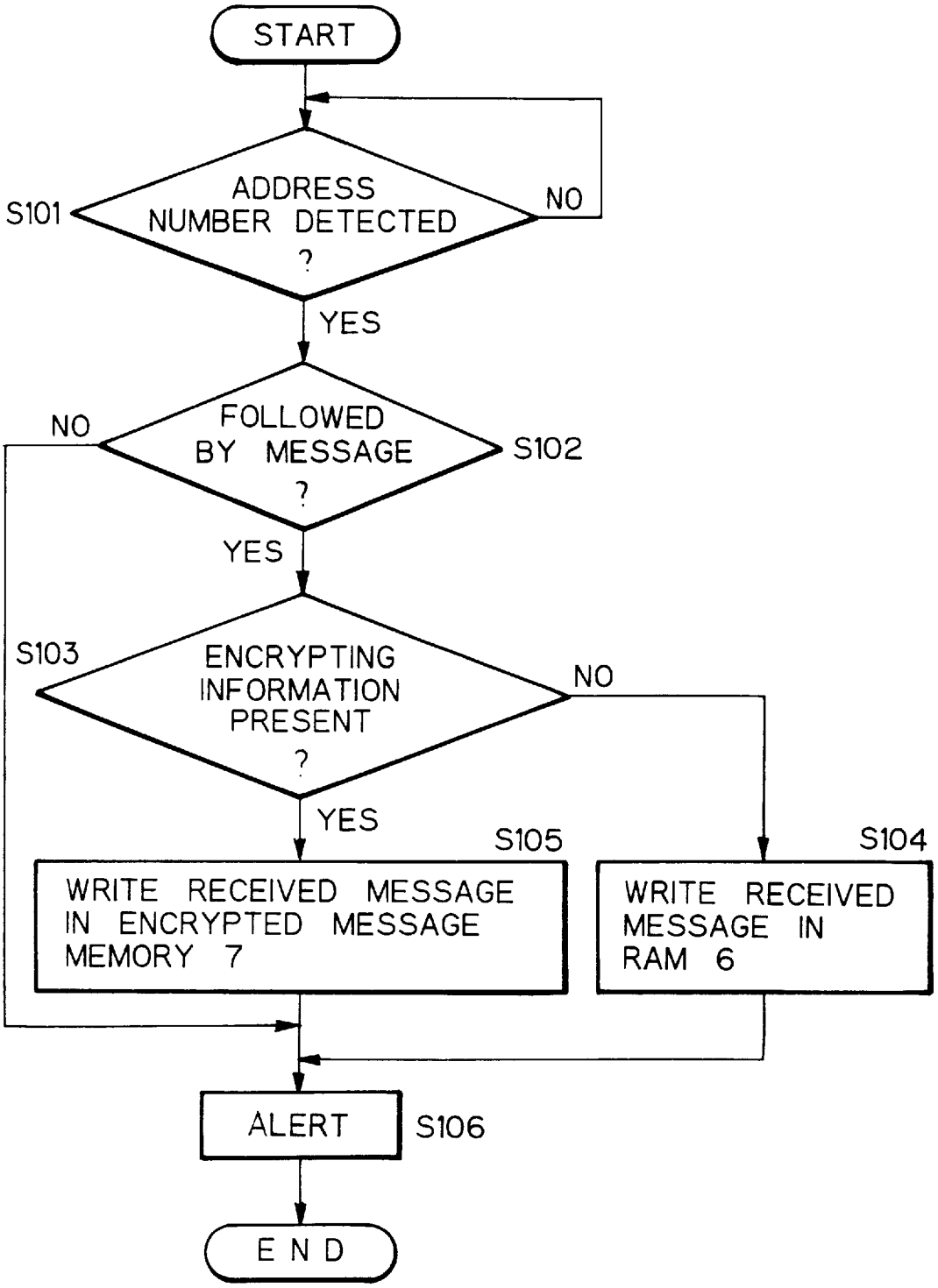
FIG. 3 is a flowchart demonstrating a message receipt and storage procedure particular to the embodiment.

A reference will be made to FIG. 3 for demonstrating the message receipt and storage particular to the illustrative embodiment in detail. First, whether or not the address or ID number included in the received paging signal is identical with the address number stored in the ROM 5 is determined (step S101). If the answer of the step S101 is positive (YES), whether or not a codeword following the address number is a message is determined (step S102). If the answer of the step S102 is negative (NO), conventional means, not shown, alerts the receipt of a call to the user (step S106). If the answer of the step S102 is YES, whether or not the message signal includes a preselected encrypting information is determined (step S103). If the answer of the step S103 is NO, the message signal is written to the RAM 6. If the answer of the step S103 is YES, the message signal is written to the encrypted message memory 7 (step S105). At this instant, the encrypting information may be written to the memory 7 together with the message signal, if desired. For example, particular encrypting information may be agreed upon between the user of the pager and the individual caller. After the message signal has been written to the RAM 6 or the message memory 7, an alert is produced to alert the user to the receipt of the call (step S106).

The illustrative embodiment assigns a particular memory to each of the message signal with encrypting information and the message signal without it. Alternatively, such two kinds of message signals may both be written to a single memory in distinction from each other. Again, encrypting information may be stored together with the associated message signals.

Figure 4:
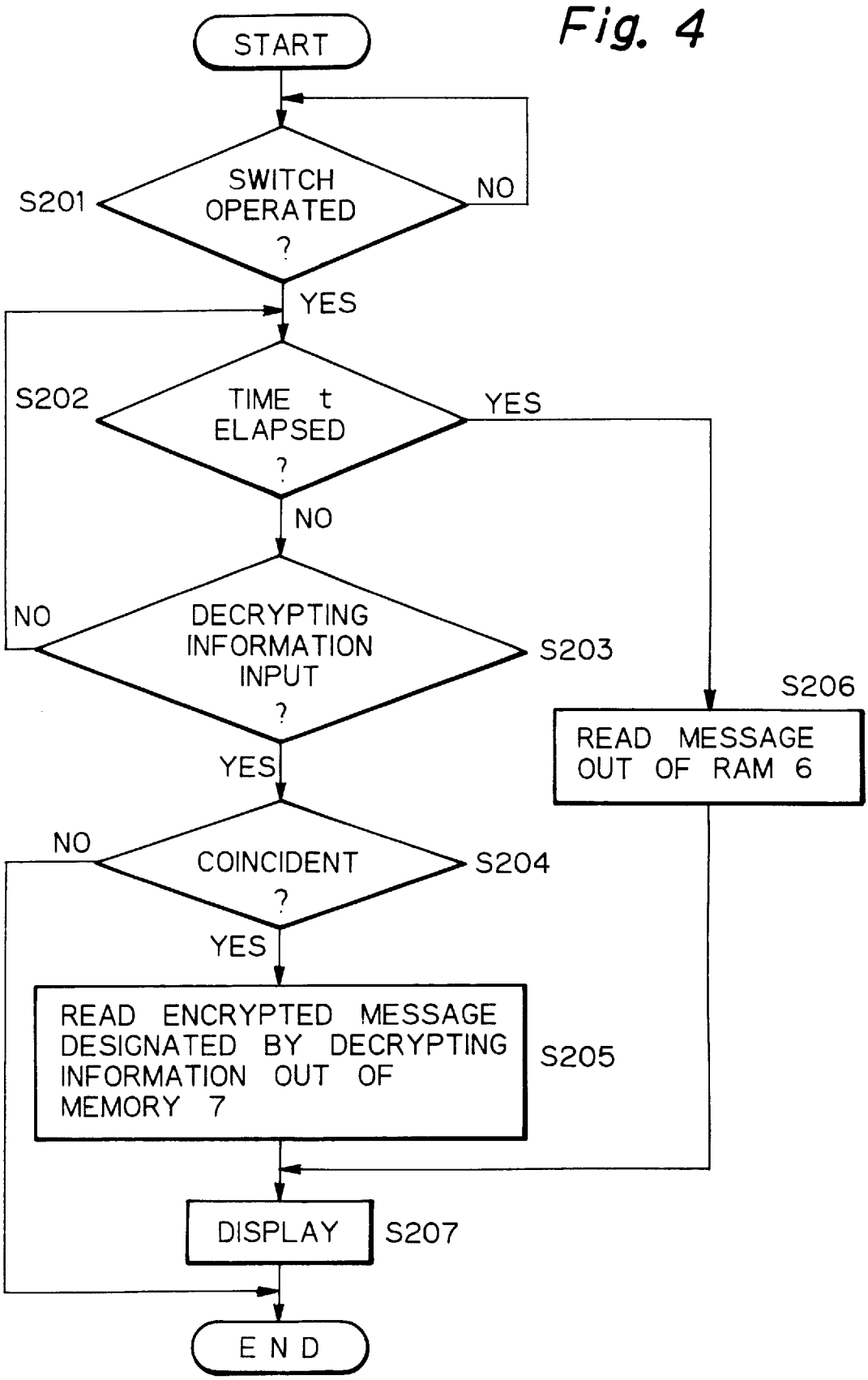
FIG. 4 is a flowchart demonstrating a message display procedure also particular to the embodiment.

FIG. 4 shows a procedure for displaying the stored message on the display 9. As shown, assume that the user operates the message call switch 10 in order to read a message (step S201). Then, whether or not a preselected period of time t has elapsed is determined (step S202). When the user enters decrypting information via the decrypting information input 11 before the period of time r elapses (step S203), whether or not the information matches the decrypting information is determined (step S204). If the answer of the step S204 is YES, the message signal having encrypting information matching the decrypting information is read out of the message memory 7 (step S205). On the other hand, assume that the period of time r has elapsed without any encrypting information entered after the operation of the switch 10 (YES, step S202). Then, the message signals stored in the RAM 6 are sequentially read out (step S206). The message read out in the step S205 or S206 appears on the display 9 (step S207). If the input decrypting information does not match the encrypting information, then the program simply ends without reading out any message signal out of the message memory.

Only a single kind of encrypting information may be agreed upon between the user of the pager and a plurality of callers, as stated earlier. In such a case, only the message signals with the single encrypting information will be stored in the exclusive message memory 7 and will be sequentially read out and displayed in response to decrypting information matching the encrypting information. Alternatively, when particular encrypting information is agreed upon between the user and each caller, each message signal with the respective encrypting information will be written to the message memory 7 together with the information and will be read out later in response to decrypting data matching the encrypting information.

As stated above, the illustrative embodiment allows a caller to send a private message to the user of the pager only if particular encrypting information is agreed upon between the former and the latter. The user of the pager can readily call and see the private message simply by entering decrypting information on the pager. The decrypting information may be identical with or different from the encrypting information, as desired.

Figure 5:
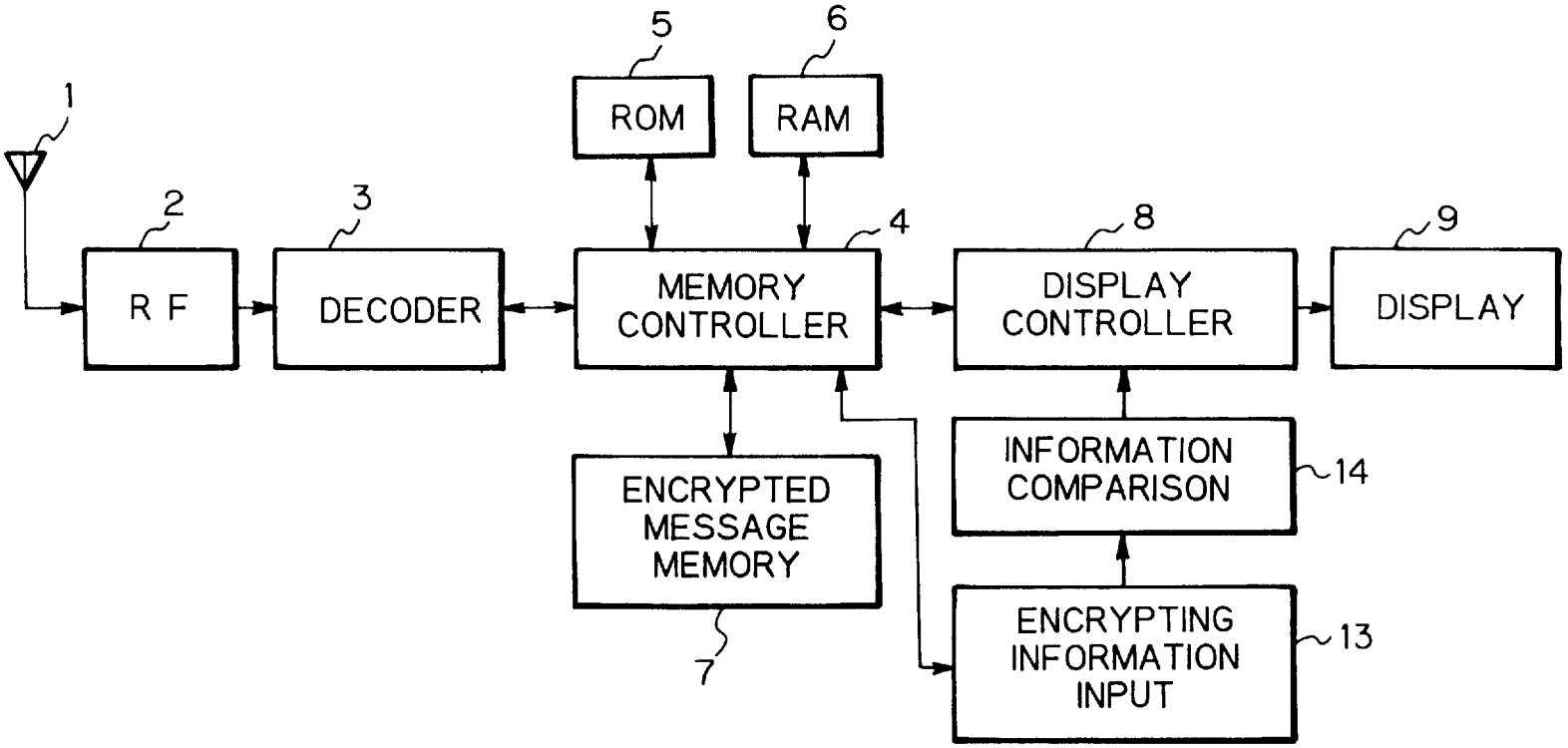
FIG. 5 is a block diagram schematically showing an alternative embodiment of the present invention.

Referring to FIG. 5, an alternative embodiment of the present invention is shown. In FIG. 5, boxes identical with the boxes shown in FIG. 1 are designated by like reference numerals, and a detailed description thereof will not be made in order to avoid redundancy. As shown, this embodiment has an encrypting information input 13 and an information comparison 14 in addition to the antenna 1, RF section 2, decoder 3, memory controller 4, ROM 5, RAM 6, encrypted message memory 7, display controller 8, and display 9.

Message receipt and data storage to occur in the illustrative embodiment will be outlined first. A paging signal coming in through the antenna 1 is demodulated by the RF section 2 and then input to the decoder 3. The decoder 3 compares an address number included in the demodulated signal with an address assigned to the pager and read out of the ROM 5 via the memory controller 4. If the two address signals compare equal, the decoder 3 delivers a message signal following the ID to the memory controller 4. If otherwise, the decoder 3 does not accept signals which may follow the ID. The memory controller 4 writes the message signal in the RAM 6 while being displayed on the display 9 via the display controller 8.

Assume that the user watching the message on the display 9 wants to keep it secret. Then, the user enters encrypting signal on the encrypting information input 13. As a result, the message signal is read out of the RAM 6 and then written to the encrypted message memory 7 together with the encrypting information.

To read the message signal out of the message memory 7, the user of the pager enters the encrypting information added to the message signal via the input 13. The information comparison 14 determines whether or not the entered encrypting information is identical with the encrypting information added to the message signal. If the former is identical with the latter, the comparison 14 causes the message signal to be read out of the message memory 7 and fed to the display 9 via the display controller 8. If the answer of the above decision is negative, the message signal with the encrypting information is not read out of the message memory or displayed.

Figure 6:
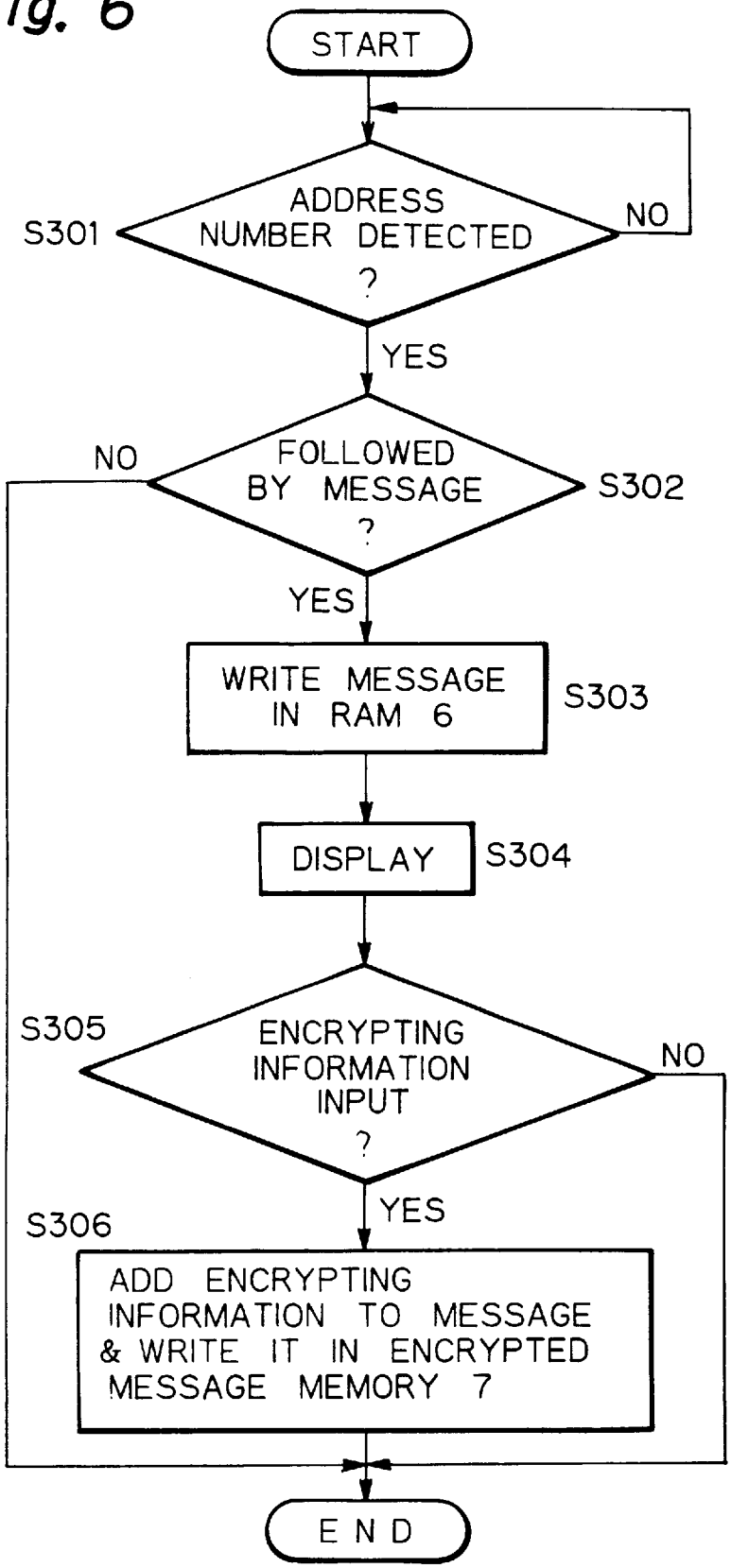
FIG. 6 is a flowchart showing a message receipt, storage and encrypting information addition procedure particular to the embodiment shown in FIG. 5.

Message receipt and storage and information addition particular to the above embodiment will be described in detail, again assuming the signal format shown in FIGS. 2A–2D. As shown in FIG. 6, whether or not the address number included in the received paging signal is identical with the address number stored in the ROM 5 is determined (step S301). If the answer of the step S301 is YES, whether or not a codeword following the address number is a message signal is determined (step S302). If the answer of the step S302 is YES, the message signal is written to the RAM 6 (step S303) and then displayed on the display 9 (step S304). When the user enters encrypting information, the message signal is read out of the RAM 6 and then written to the encrypted message memory 7 together with the entered encrypting information (step S306). However, adding the encrypting information to the message signal is not essential. For example, when a single encrypting information is used, only the message signal should be transferred from the RAM 6 to the message memory 7 because it is not necessary to distinguish a plurality of different encrypting information.

This embodiment also assigns a particular memory to each of the message signals with encrypting information and the message signals without it. Alternatively, such two kinds of message signals may both be written to a single memory in distinction from each other.

Figure 7:
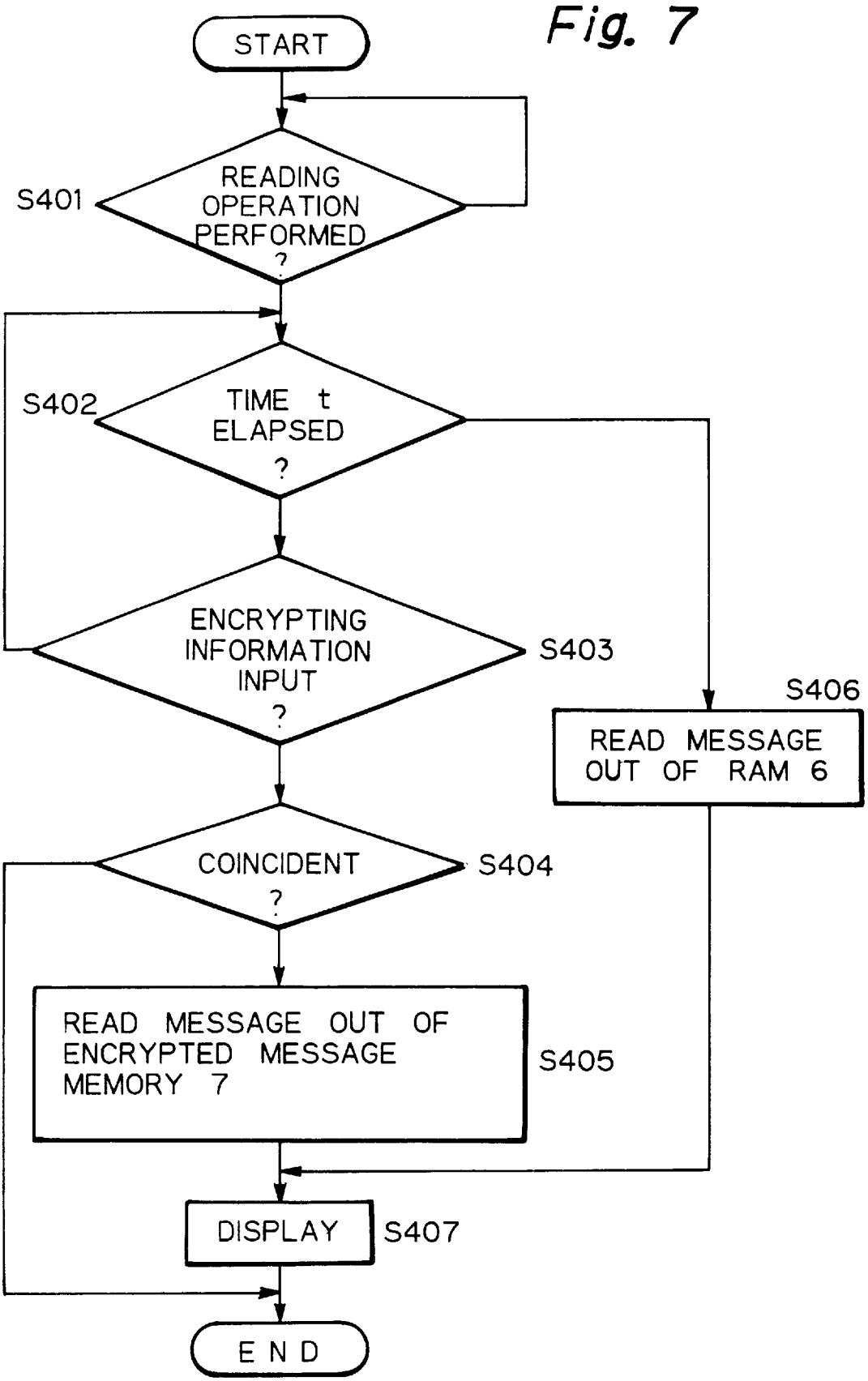
FIG. 7 is a flowchart showing a message signal read-out and display procedure also particular to the embodiment shown in FIG. 5.

FIG. 7 shows a procedure for reading out and displaying the stored message. As shown, assume that the user performs a messaging reading operation (step S401). Then, whether or not the preselected period of time r has elapsed is determined (step S402). When the user enters encrypting information via the encrypting information input 13 before the period of time r elapses (step S403), whether or not the information matches the encrypting information attached to the message signal is determined (step S404). If the answer of the step S404 is YES, the message signal having the designated encrypting information is read out of the encrypted message memory 7 (step S405). On the other hand, assume that the period of time r has elapsed without any encrypting information entered (YES, step S402). Then, the message signals stored in the RAM 6 are sequentially read out (step S406). The message read out in the step S405 or S406 appears on the display 9 under the control of the display controller 8 (step S407). If the answer of the step S404 is NO, then the program simply ends without reading out any message signal out of the encrypted message memory 7.

In the illustrative embodiment, the user is expected to add the encrypting information on a message-by-message basis, so that a message signal designated by encrypting information is read out. Alternatively, if a single encrypting information is agreed upon between the user and expected callers, then an arrangement may be made such that only message signals designated by the information are written to an encrypted message memory and then sequentially read out when the information is input.

In summary, it will be seen that the present invention provides a radio pager which allows encrypting information to be added to a received message and thereby inhibits persons other than the user of the pager or an authorized person knowing the information from seeing private messages. Private messages can therefore be stored in the memory of the pager without being deleted.

Various modifications will become possible for those skilled in the art after receiving the teachings of the present disclosure without departing from the scope thereof.

What is claimed is:

1. A radio pager comprising:

receiving means for receiving a paging signal sent from a caller;

storing means for storing a message included in the paging signal;

first decision means for determining whether or not encrypting information for inhibiting the message from being displayed is attached to the paging signal;

display means for displaying the message; and second decision means for determining whether or not the message with the encrypting information should be displayed, wherein said storing means comprises a first storage area for storing the message with the encrypting information, and a second storage area for storing the message without the encrypting information.

2. A radio pager as claimed in claim 1, wherein said second decision means comprises inputting means for allowing decrypting information to be input, and comparing means for comparing the decrypting information and the encrypting information.

3. A radio pager as claimed in claim 2, wherein said display means displays the message when said comparing means determines that the decrypting information matches the encrypting information.

4. A radio pager comprising:

receiving means for receiving a paging signal sent from a caller;

decision means for determining whether or not encrypting information is attached to a message included in the paging signal;

first storing means for storing the message to which the encrypting information is not attached;

second storing means for storing the message to which the encrypting information is attached;

first reading means for reading the message out of said first storing means; and second reading means for reading the message out of said second storing means.

5. A radio pager as claimed in claim 4, wherein said second storing means stores the encrypting information together with the message.

6. A radio pager as claimed in claim 5, wherein said second storing means comprises inputting means for allowing decrypting information matching the encrypting information to be input, and wherein when the decrypting information is input on said inputting means, said second reading means reads the message having the encrypting information out of said second storing means.

7. A radio pager comprising:

receiving means for receiving a paging signal from a caller;

storing means for storing a message included in the paging signal;

display means for displaying the message;

adding means for allowing encrypting information to be added to the message for inhibiting the message from being displayed; and decision means for determining whether or not the message to which the encrypting information is added should be displayed.

8. A radio pager as claimed in claim 7, wherein said storing means comprises a first storage for storing the message to which the encrypting information is added, and a second storage for storing the message to which the encrypting information is not added.

9. A radio pager as claimed in claim 7, wherein when the encrypting information is input while the message is displayed, the message is inhibited from being displayed afterwards.

10. A radio pager as claimed in claim 7, wherein said decision means comprises inputting means for allowing the encrypting information to be input, and comparing means for comparing the encrypting information input on said inputting means and the encrypting information added to the message.

11. A radio pager as claimed in claim 10, wherein when the encrypting information compare equal, said display means displays the message designated via said inputting means.

* * * * *